US007228921B1

(12) United States Patent
Houg et al.

(10) Patent No.: US 7,228,921 B1
(45) Date of Patent: Jun. 12, 2007

(54) ICE AUGER COVERING APPARATUS

(76) Inventors: Daniel K. Houg, 1741 S. Cleveland Ave. Suite 301, Sioux Falls, SD (US) 57103; Mark R. Houg, 1741 S. Cleveland Ave. Suite 301, Sioux Falls, SD (US) 57103

( * ) Notice: Subject to any disclaimer, the term of this patent is extended or adjusted under 35 U.S.C. 154(b) by 232 days.

(21) Appl. No.: 11/170,689

(22) Filed: Jun. 29, 2005

(51) Int. Cl.
*E21B 10/44* (2006.01)
*E21B 12/04* (2006.01)
*F25C 5/02* (2006.01)

(52) U.S. Cl. ..... 175/307; 175/18; 30/504

(58) Field of Classification Search ..... 175/307, 175/18; 30/504; 299/24
See application file for complete search history.

(56) References Cited

U.S. PATENT DOCUMENTS 1,563,887 A 12/1925 Wiespetat
4,132,497 A 1/1979 Weller et al.
4,390,212 A * 6/1983 Nitzberg ..... 299/57
4,539,750 A 9/1985 Jarvi et al.
4,947,943 A 8/1990 Litwak
7,021,866 B2 * 4/2006 Keefe ..... 405/244

FOREIGN PATENT DOCUMENTS

JP 03107090 A * 5/1991

* cited by examiner

*Primary Examiner*—Kenneth Thompson

(57) ABSTRACT

An ice auger covering apparatus includes a housing that has a bottom wall and a peripheral wall that is attached to and extends upwardly from the bottom wall. The housing has a break therein so that the housing includes a first portion and a second portion. The first and second portions are hingedly coupled together and biased toward each other in a closed position. A plurality of blade engaging members is provided. Each of the blade engaging members is configured to receive an edge of a bottom blade. The blade engaging members are attached to an inner surface of the peripheral wall. A pointed end of the ice auger is extendable into the housing and bottom blades of the auger engaged with the blade engaging members so that the housing covers the pointed end and the bottom blades.

24 Claims, 9 Drawing Sheets

ICE AUGER COVERING APPARATUS

BACKGROUND OF THE INVENTION

1. Field of the Invention

The present invention relates to covering devices and more particularly pertains to a new covering device for extending over a bottom end of a motorized ice auger for the purpose of protecting an end tip and bottom blades of the ice auger.

2. Description of the Prior Art

The use of covering devices is known in the prior art. U.S. Pat. No. 4,539,750 describes a device for positioning on and extending along the length of an ice auger to completely cover the threads and bottom end of the ice auger. An ice auger having a removable cap is found in U.S. Pat. No. 4,947,943 and includes an auger body having a particular shape well suited for receiving and engaging the cap. A general covering is found in U.S. Pat. No. 4,132,497 and includes a housing having an open upper end and a side door for receiving a power-drilling tool. A drill press guard is found in U.S. Pat. No. 1,563,887.

While these devices fulfill their respective, particular objectives and requirements, the need remains for a device that has a structure configured for removably engaging the end of a conventional ice auger. In particular, the device should cover the bottom point and cutting blades of the auger. This will protect the cutting blades and point from damage as well as prevent injuries to people and property from accidental contact with the point and the cutting blades.

SUMMARY OF THE INVENTION

The present invention meets the needs presented above by generally comprising a housing that has a bottom wall and a peripheral wall that is attached to and extends upwardly from the bottom wall. The housing has a break therein so that the housing includes a first portion and a second portion. The first and second portions are hingedly coupled together. The first portion is selectively pivotable away from the second portion to define an open position or abutting the second portion to define a closed position. A biasing member is mounted on the housing and is configured to bias the housing in the closed position. A plurality of blade engaging members is provided. Each of the blade engaging members is configured to receive an edge of a bottom blade. The blade engaging members are attached to an inner surface of the peripheral wall. A pointed end of the ice auger is extendable into the housing and bottom blades of the auger engaged with the blade engaging members so that the housing covers the pointed end and the bottom blades.

The present invention also meets the needs presented above by generally comprising a housing that has a bottom wall and a peripheral wall that is attached to and extends upwardly from the bottom wall. The housing has a break therein and includes a first portion and a second portion. The first and second portions are hingedly coupled together. The first portion is selectively pivotable away from the second portion to define an open position or abutting the second portion to define a closed position. A biasing member is mounted on the housing and is configured to bias the housing in the closed position. At least one blade engaging member is configured to receive an edge of a bottom blade. The at least one blade engaging member is attached to an inner surface of the peripheral wall. A pointed end of the ice auger is extendable into the housing and bottom blades of the auger engaged with the blade engaging members so that the housing covers the pointed end and the bottom blades.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
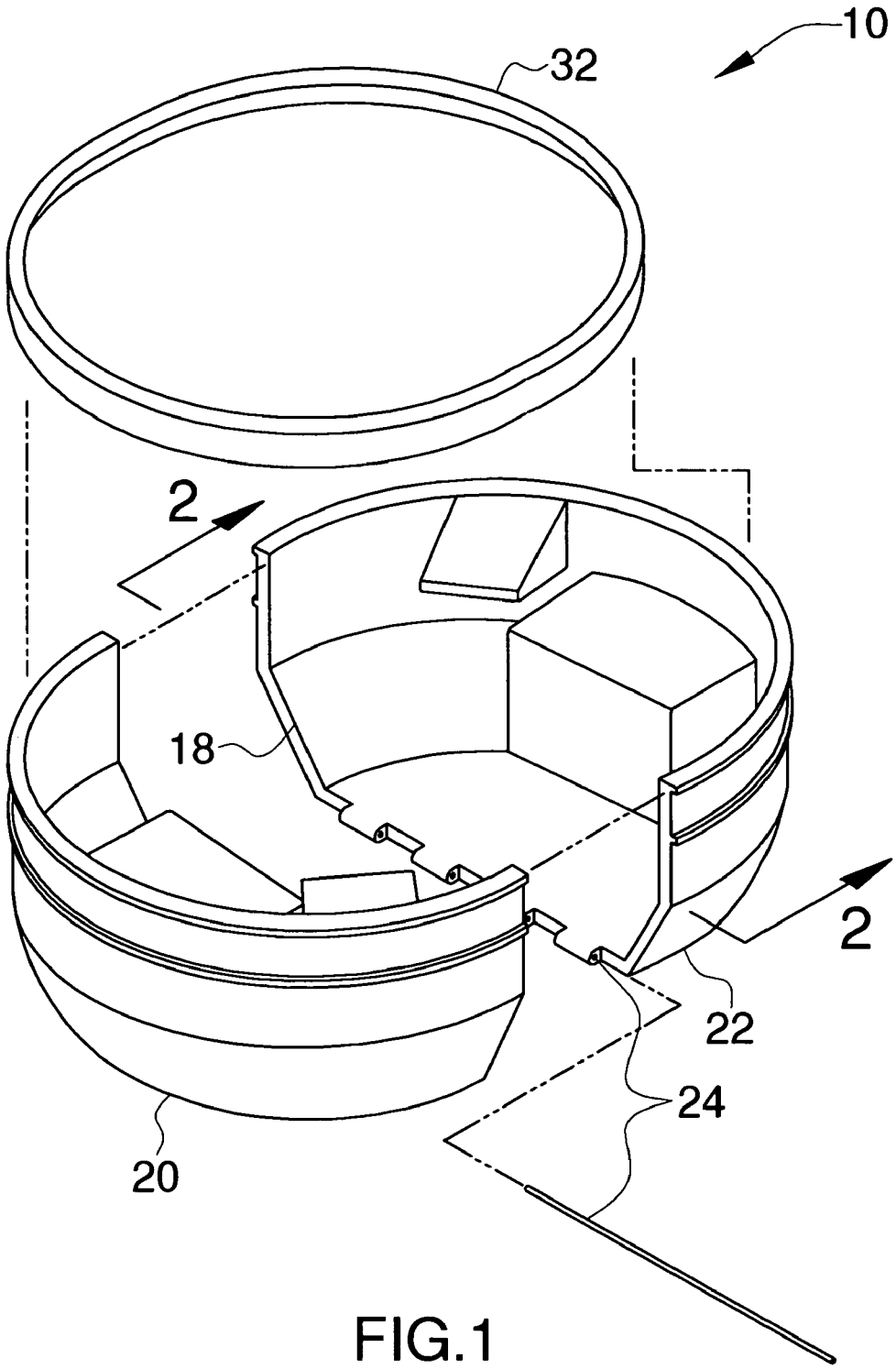
FIG. 1 is an expanded perspective view of a ice auger covering apparatus according to the present invention.
Figure 2:
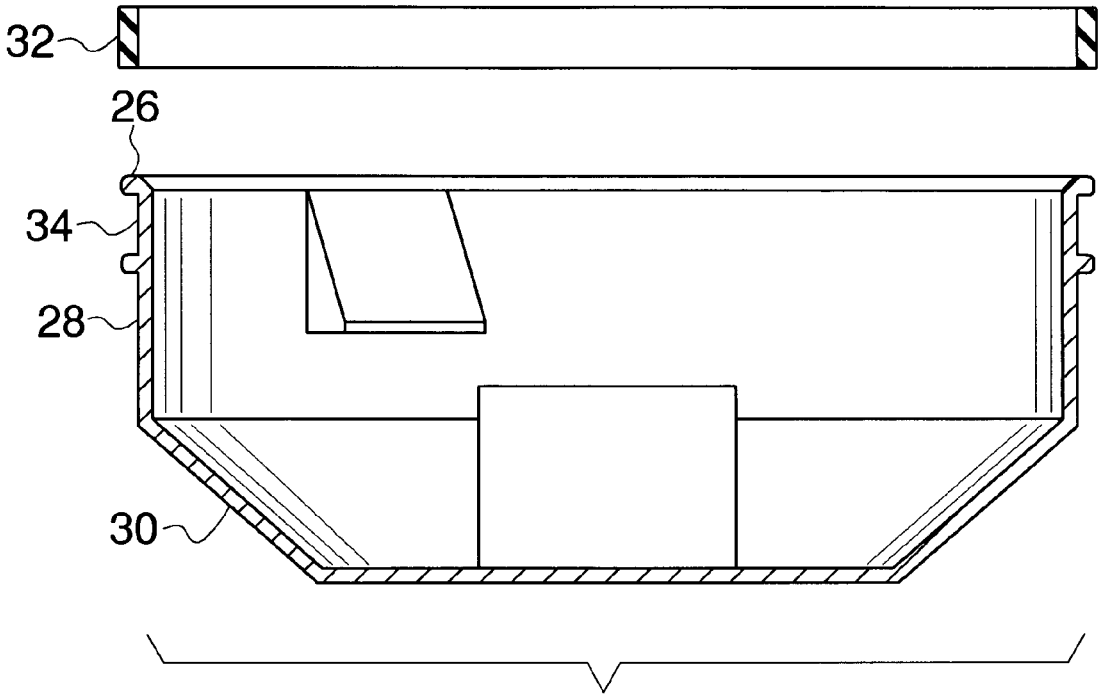
FIG. 2 is a cross-sectional view taken along line 2-2 of FIG. 1 of the present invention.
Figure 3:
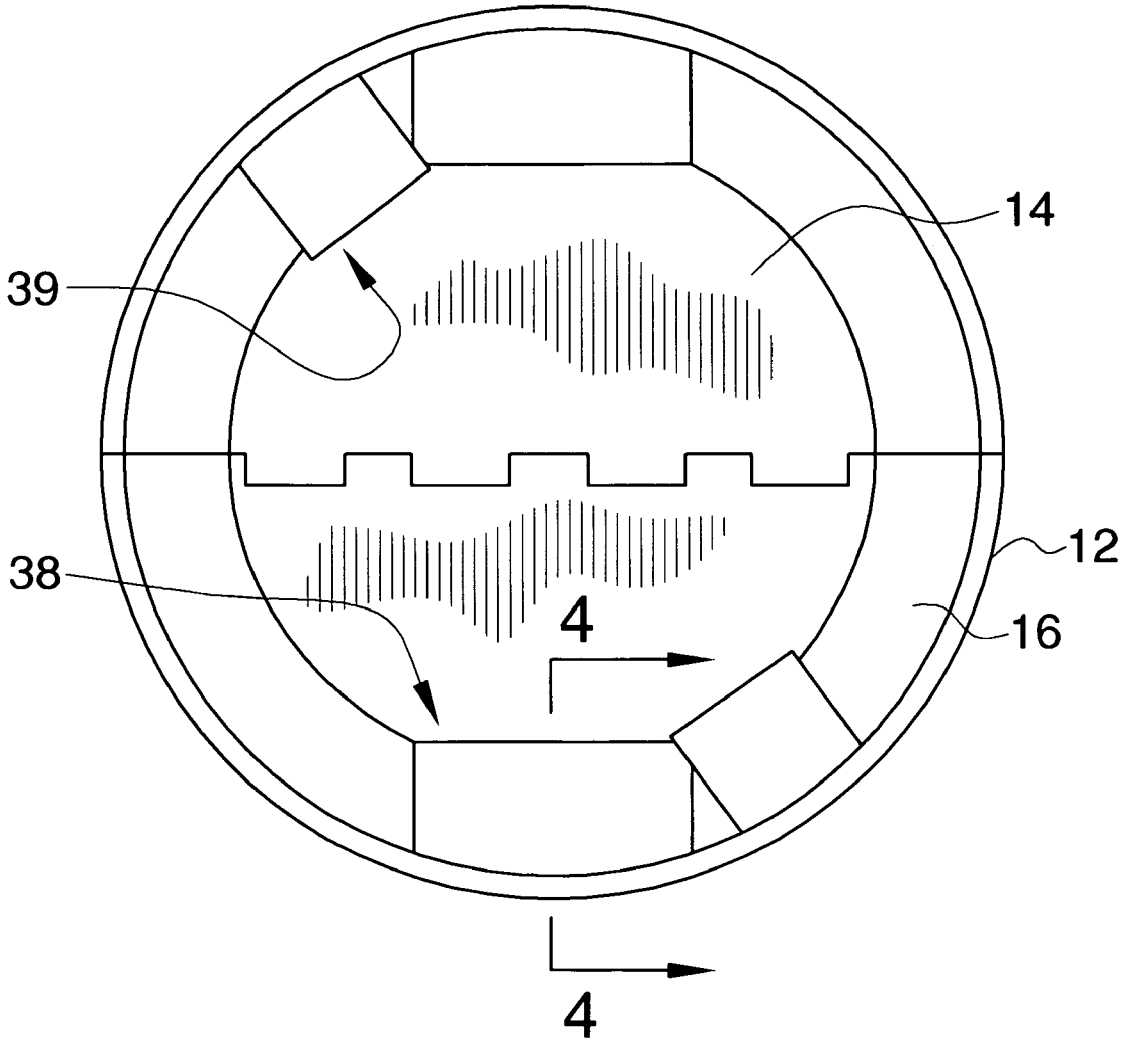
FIG. 3 is a top view of the present invention.
Figure 4:
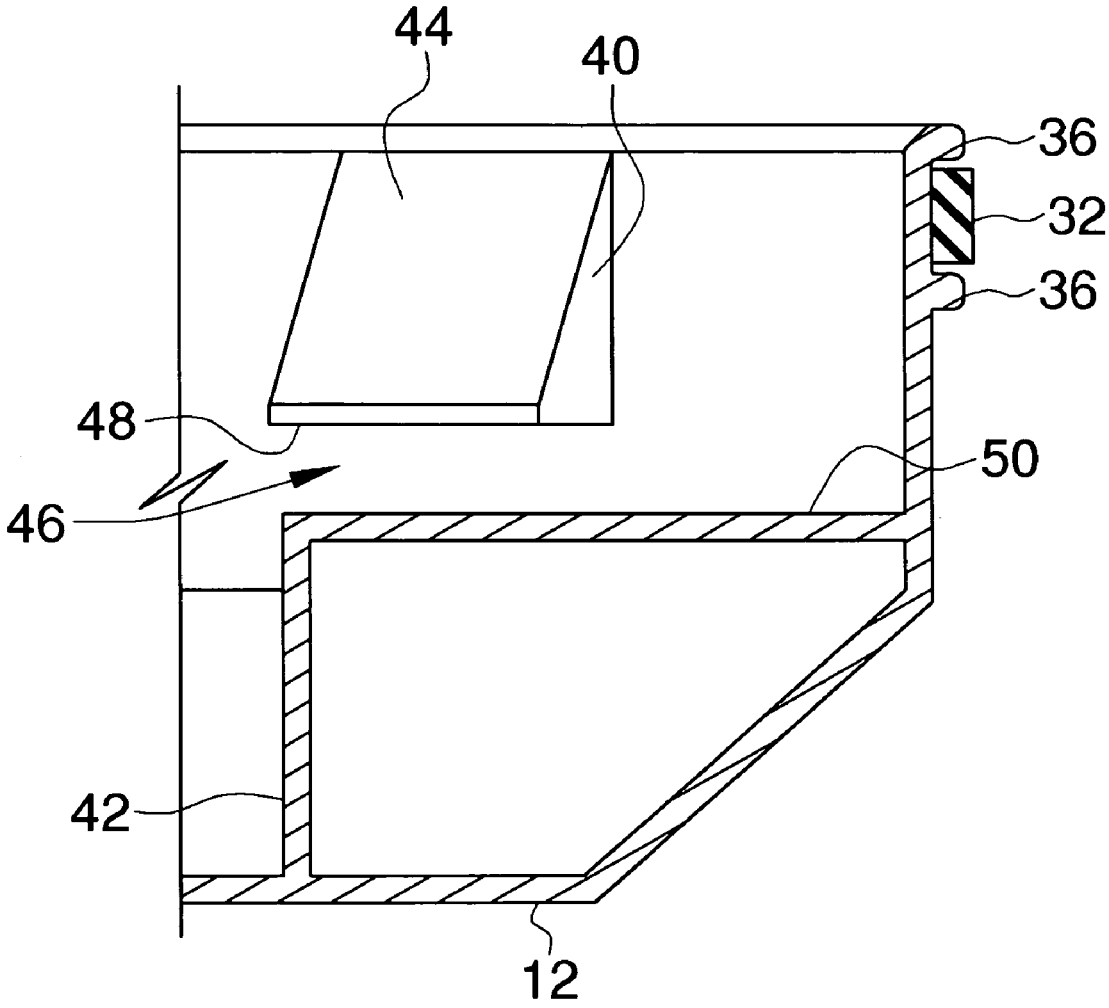
FIG. 4 is a cross-sectional view taken along line 4-4 of FIG. 3 of the present invention.
Figure 5:
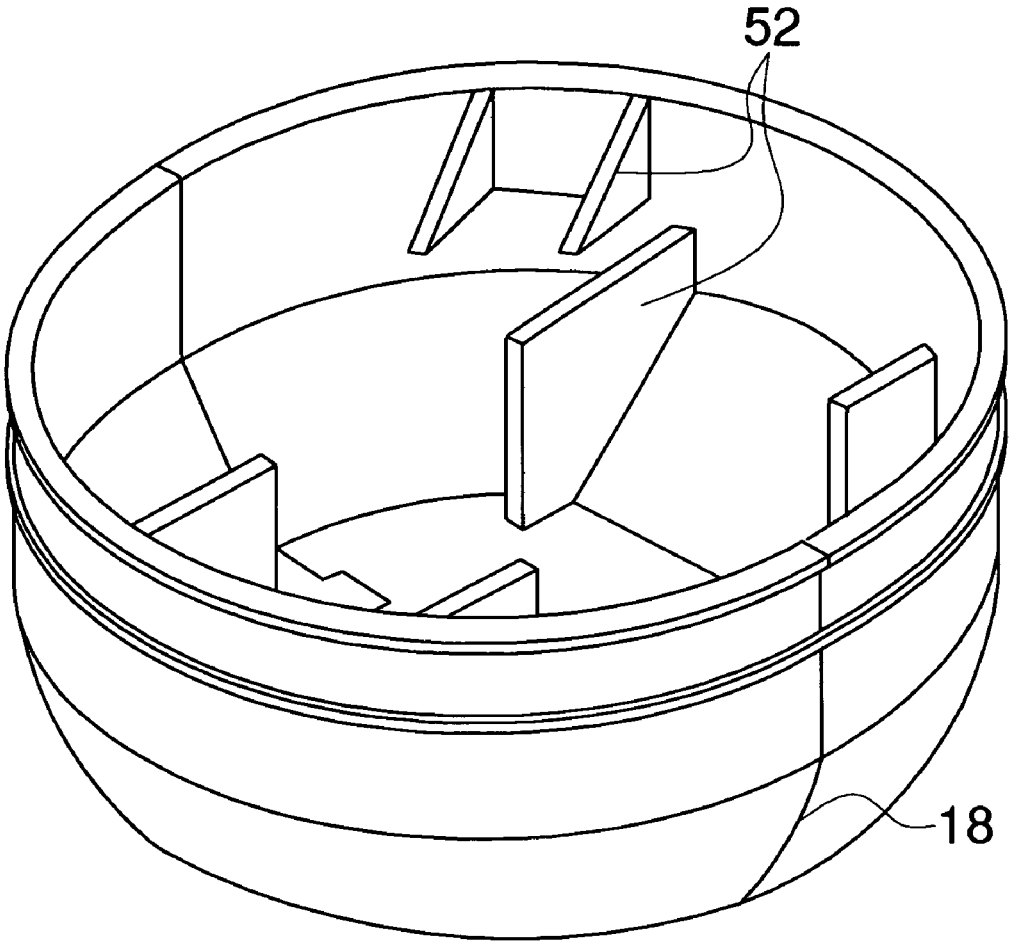
FIG. 5 is a perspective view of a second embodiment of the present invention.
Figure 6:
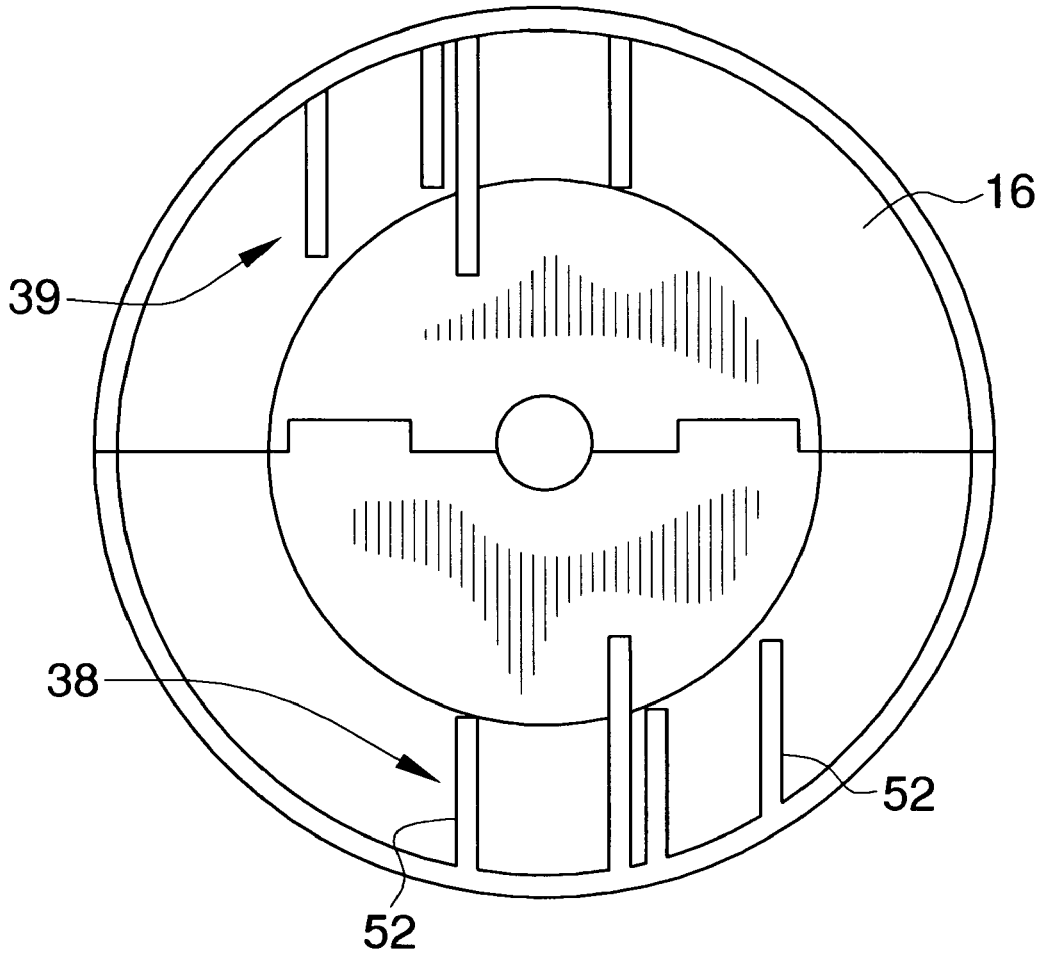
FIG. 6 is a top view of the second embodiment of the present invention.
Figure 7:
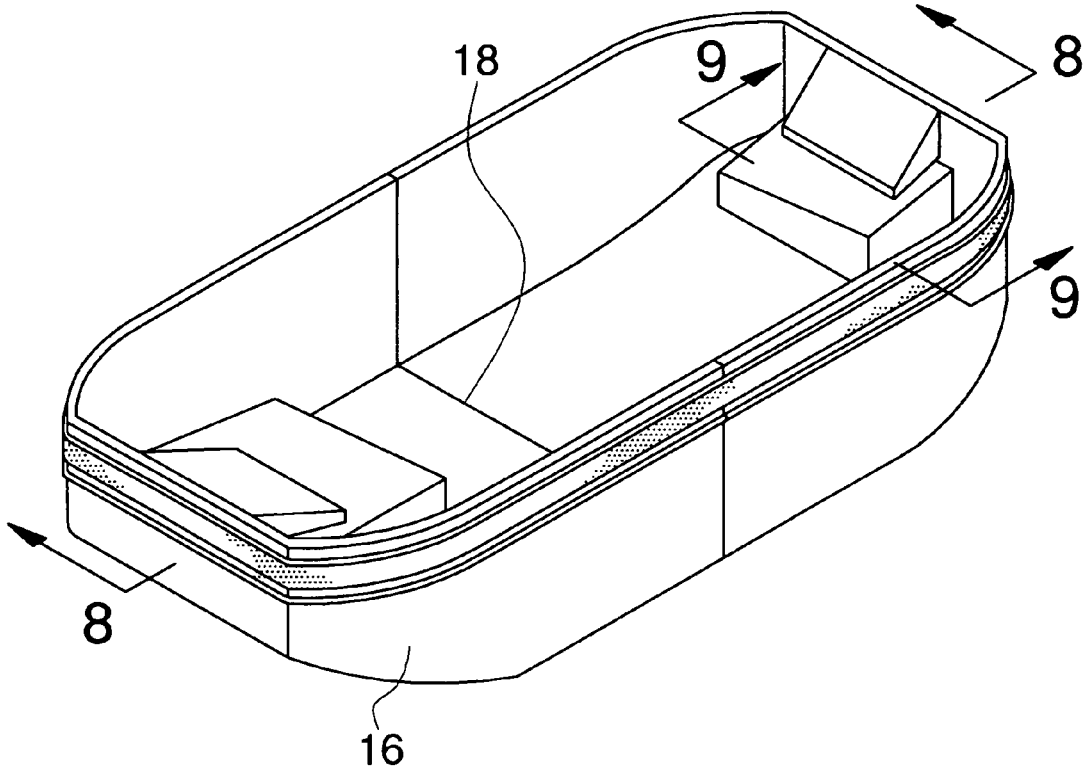
FIG. 7 is a perspective view of a third embodiment of the present invention.
Figure 10:
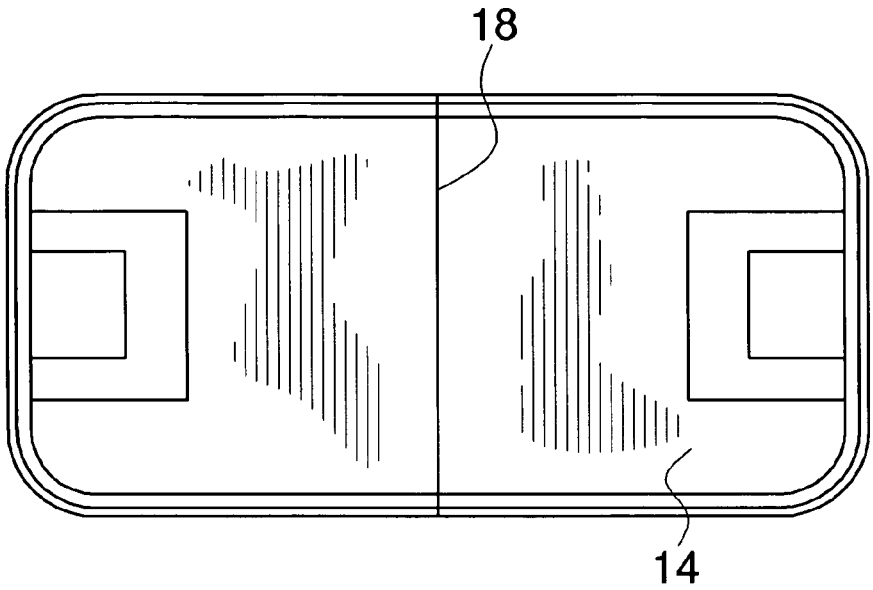
FIG. 10 is a top view of the third embodiment of the present invention.
Figure 8:
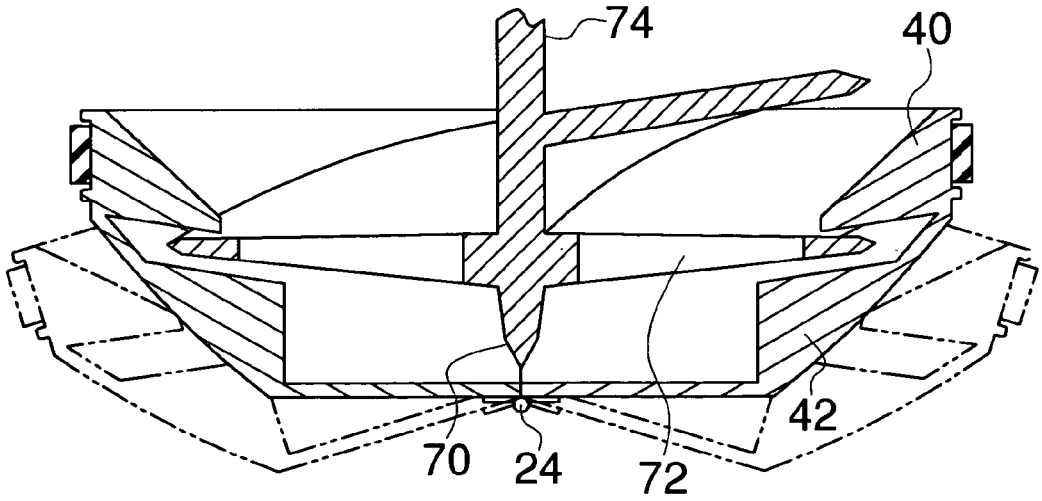
FIG. 8 is a cross-sectional view taken along line 8-8 of FIG. 7 of the present invention depicting the invention in-use.
Figure 9:
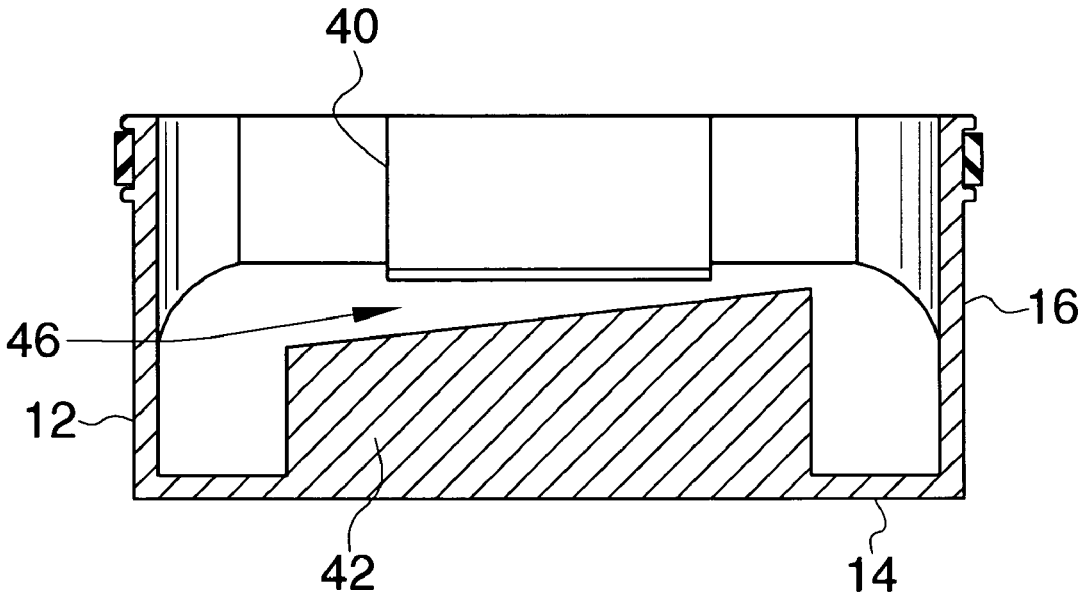
FIG. 9 is a cross-sectional view taken along line 9-9 of FIG. 7 of the present invention.

With reference now to the drawings, and in particular to FIGS. 1 through 10 thereof, a new covering device embodying the principles and concepts of the present invention and generally designated by the reference numeral 10 will be described.

As best illustrated in FIGS. 1 through 10, the ice auger covering apparatus 10 generally comprises an apparatus configured to removably receive and cover a pointed end 70 and bottom blade 72 or blades of a conventional powered ice auger 74. The apparatus 10 includes a housing 12 that has a bottom wall 14 and a peripheral wall 16 that is attached to and extends upwardly from the bottom wall 14. The housing 12 has a break 18 therein so that the housing 12 includes a first portion 20 and a second portion 22. The first 20 and second 22 portions are hingedly coupled together. The first portion 20 is selectively pivotable away from the second portion 22 to define an open position or abutting the second portion to define a closed position. The break 18 extends through the bottom wall 14 and the peripheral wall 16 so that the first 20 and second 22 portions have generally the same size. A hinge 24 couples the bottom wall 14 of the first portion 20 to the bottom wall 14 of the second portion 22.

The peripheral wall 16 has an upper edge 26 and includes an upper portion 28 positioned adjacent to the upper edge 26 and a lower portion 30 positioned adjacent to the bottom wall 14. The lower portion 30 is angled inward from the upper portion 28 to the bottom wall 14. The bottom wall 14 has a generally cylindrical shape and has a diameter generally between 3 inches and 8 inches. However, FIGS. 7-10 depict a third embodiment having an elongated bottom wall 14. The upper portion 28 of the peripheral wall has a diameter generally between 7 inches and 14 inches. The peripheral wall 16 has a height generally between 4 inches and 8 inches.

A biasing member 32 is mounted on the housing 12 and is configured to bias the housing 12 in the closed position by biasing the first 20 and second 22 portions together. The biasing member 32 comprises a resiliently elastic band that extends around and abuts the peripheral wall 16. The band, or biasing member 32, is positioned on the upper portion 28 of the peripheral wall 16. The peripheral wall 16 has a peripheral slot 34 therein positioned adjacent to the upper edge 26. The band 32 is positioned in the peripheral slot 34. The slot 34 may be formed by a pair of spaced peripheral flanges 36.

At least one blade engaging member 38 and preferably a plurality of blade engaging members 38, 39 is provided. Each of the blade engaging members 38, 39 is configured to receive an edge of the bottom blade 72. Each of the blade engaging members 38, 39 is attached to an inner surface of the peripheral wall 16. A first of the blade engaging members 38 is attached to the inner surface of the first portion 20 and a second of the blade engaging members 39 is attached to the inner surface of the second portion 22. The first 38 and second 39 blade engaging members are positioned generally opposite with respect to each other.

Each of the blade engaging members 38, 39 includes an upper support 40 positioned adjacent to the upper edge 26 of the peripheral wall 16 and a lower support 42 positioned adjacent to the bottom wall 14. The upper support 40 has an upper side 44 that is angled downward from the upper edge 26 of the peripheral wall 16 and toward the bottom wall 14. The upper support 40 extends between 1 inch and 2 inches laterally away from the peripheral wall 16. A blade receiving space 46 is defined between a bottom side 48 of the upper support 40 and a top side 50 of the lower support 42. The blade receiving space 46 has a height less than 2 inches. In the first and second embodiments shown in FIGS. 1-6, the top side 50 of the lower support 42 lies in a plane orientated parallel with respect to a plane of the bottom wall 14. The first embodiment includes generally solid upper sides 26 and top 50 and bottom 48 sides. The second embodiment utilizes vertically orientated plates 52 to form the upper 40 and lower 42 supports.

In use, the pointed end 70 of the ice auger 74 is extended into the housing 12. The bottom blades 72 of the auger 74 press against the upper supports 40 and, in doing so, urge the first 20 and second 22 portions apart into the open position. This allows the bottom blades 72 to slide down the upper supports 40 and snap into, or engage with, the blade receiving spaces 46 of the blade engaging members 38, 38. Once engaged with bottom blades 72, the housing 12 covers the pointed end 70 and the bottom blades 72. To remove the housing 12 from the auger 74, a user urges the first 20 and second 22 portions apart and slides bottom blades 72 out of the blade engaging members 38, 39.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An ice auger covering assembly configured to removably receive and cover a pointed end and bottom blade of an ice auger, said covering comprising:

a housing having a bottom wall and a peripheral wall being attached to and extending upwardly from said bottom wall, said housing having a break therein such that said housing includes a first portion and a second portion, said first and second portions being hingedly coupled together, said first portion being selectively pivotable away from said second portion to define an open position or abutting said second portion to define a closed position;

a biasing member being mounted on said housing and being configured to bias said housing in said closed position;

a plurality of blade engaging members, each of said blade engaging members being configured to receive an edge of the bottom blade, each of said blade engaging members being attached to an inner surface of said peripheral wall; and wherein the pointed end of the ice auger is extendable into said housing and the bottom blades of the auger engaged with said blade engaging members such that said housing covers the pointed end and the bottom blades.

2. The assembly according to claim 1, wherein said break extends through said bottom wall, a hinge coupling said bottom wall of said first portion to said bottom wall of said second portion.

3. The assembly according to claim 1, wherein said peripheral wall has an upper edge, said peripheral wall having an upper portion positioned adjacent to said upper edge and a lower portion positioned adjacent to said bottom wall, said lower portion being angled inward from said upper portion to said bottom wall.

4. The assembly according to claim 3, wherein said bottom wall has a generally cylindrical shape.

5. The assembly according to claim 1, wherein said bottom wall has a generally cylindrical shape.

6. The assembly according to claim 1, wherein said biasing member comprises a resiliently elastic band, said band extending around and abutting said peripheral wall.

7. The assembly according to claim 6, wherein said peripheral wall has a peripheral slot therein positioned adjacent to an upper edge of said peripheral wall, said band being positioned in said peripheral slot.

8. The assembly according to claim 6, wherein said peripheral wall has a peripheral slot therein, said band being positioned in said peripheral slot.

9. The assembly according to claim 1, wherein a first of said blade engaging members is attached to said inner surface of said first portion and a second of said blade engaging members is attached to said inner surface of said second portion.

10. The assembly according to claim 9, wherein each of said blade engaging members includes:

an upper support positioned adjacent to an upper edge of said peripheral wall; and a lower support positioned adjacent to said bottom wall, a blade receiving space being defined between a bottom side of said upper support and a top side of said lower support.

11. The assembly according to claim 10, wherein said blade receiving space has a height less than 2 inches.

12. The assembly according to claim 11, wherein said top side of said lower support lies in a plane orientated parallel with respect to a plane of said bottom wall.

13. The assembly according to claim 11, wherein said top side of said lower support lies in a plane orientated parallel with respect to a plane of said bottom wall, said upper support having an upper side being angled downward from said upper edge of said peripheral wall and toward said bottom wall.

14. The assembly according to claim 10, wherein said upper support has an upper side being angled downward from said upper edge of said peripheral wall and toward said bottom wall.

15. The assembly according to claim 14, wherein said upper support extends between 1 inch and 2 inches laterally away from said peripheral wall.

16. The assembly according to claim 1, wherein each of said blade engaging members includes:

an upper support positioned adjacent to an upper edge of said peripheral wall; and a lower support positioned adjacent to said bottom wall, a blade receiving space being defined between a bottom side of said upper support and a top side of said lower support.

17. The assembly according to claim 16, wherein said blade receiving space has a height less than 2 inches.

18. The assembly according to claim 17, wherein said top side of said lower support lies in a plane orientated parallel with respect to a plane of said bottom wall.

19. The assembly according to claim 16, wherein said upper support has an upper side being angled downward from said upper edge of said peripheral wall and toward said bottom wall.

20. The assembly according to claim 19, wherein said upper support extends between 1 inch and 2 inches laterally away from said peripheral wall.

21. An ice auger covering assembly configured to removably receive and cover a pointed end and bottom blade of an ice auger, said covering comprising:

a housing having a bottom wall and a peripheral wall being attached to and extending upwardly from said bottom wall, said housing having a break therein such that said housing includes a first portion and a second portion, said first and second portions being hingedly coupled together, said first portion being selectively pivotable away from said second portion to define an open position or abutting said second portion to define a closed position, said break extending through said bottom wall, a hinge coupling said bottom wall of said first portion to said bottom wall of said second portion, said peripheral wall having an upper edge, said peripheral wall having an upper portion positioned adjacent to said upper edge and a lower portion positioned adjacent to said bottom wall, said lower portion being angled inward from said upper portion to said bottom wall, said bottom wall having a generally cylindrical shape and having a diameter generally between 3 inches and 8 inches, said upper portion of said peripheral wall having a diameter generally between 7 inches and 14 inches, said peripheral wall having a height generally between 4 inches and 8 inches;

a biasing member being mounted on said housing and being configured to bias said housing in said closed position, said biasing member comprising a resiliently elastic band, said band extending around and abutting said peripheral wall, said band being positioned on said upper portion of said peripheral wall, said peripheral wall having a peripheral slot therein positioned adjacent to said upper edge, said band being positioned in said peripheral slot;

a plurality of blade engaging members, each of said blade engaging members being configured to receive an edge of the bottom blade, each of said blade engaging members being attached to an inner surface of said peripheral wall, a first of said blade engaging members being attached to said inner surface of said first portion, a second of said blade engaging members being attached to said inner surface of said second portion, said first and second blade engaging members being positioned generally opposite with respect to each other, each of said blade engaging members including;

an upper support positioned adjacent to said upper edge of said peripheral wall, said upper support having an upper side being angled downward from said upper edge of said peripheral wall and toward said bottom wall, said upper support extending between 1 inch and 2 inches laterally away from said peripheral wall;

a lower support positioned adjacent to said bottom wall, a blade receiving space being defined between a bottom side of said upper support and a top side of said lower support, said blade receiving space having a height less than 2 inches, said top side of said lower support lying in a plane orientated parallel with respect to a plane of said bottom wall; and wherein the pointed end of the ice auger is extendable into said housing and the bottom blades of the auger engaged with said blade engaging members such that said housing covers the pointed end and the bottom blades.

22. An ice auger covering assembly configured to removably receive and cover a pointed end and bottom blade of an ice auger, said covering comprising:

a housing having a bottom wall and a peripheral wall being attached to and extending upwardly from said bottom wall, said housing having a break therein such that said housing includes a first portion and a second portion, said first and second portions being hingedly coupled together, said first portion being selectively pivotable away from said second portion to define an open position or abutting said second portion to define a closed position;

a biasing member being mounted on said housing and being configured to bias said housing in said closed position;

at least one blade engaging member being configured to receive an edge of the bottom blade, said at least one blade engaging member being attached to an inner surface of said peripheral wall; and wherein the pointed end of the ice auger is extendable into said housing and the bottom blades of the auger engaged with said blade engaging members such that said housing covers the pointed end and the bottom blades.

23. The assembly according to claim 22, wherein said break extends through said bottom wall, a hinge coupling said bottom wall of said first portion to said bottom wall of said second portion.

24. The assembly according to claim 22, wherein said at least one blade engaging members includes:

an upper support positioned adjacent to an upper edge of said peripheral wall; and a lower support positioned adjacent to said bottom wall, a blade receiving space being defined between a bottom side of said upper support and a top side of said lower support.

* * * * *